US008037620B2

(12) United States Patent
Grobler et al.

(10) Patent No.: US 8,037,620 B2
(45) Date of Patent: Oct. 18, 2011

(54) PULSE COMBUSTION DRYER APPARATUS AND METHODS

(75) Inventors: Marius Grobler, Payson, AZ (US); David A. Mirko, Payson, AZ (US); James A. Rehkopf, San Rafael, CA (US)

(73) Assignee: Pulse Holdings LLC, Payson, AZ (US)

( * ) Notice: Subject to any disclaimer, the term of this patent is extended or adjusted under 35 U.S.C. 154(b) by 0 days.

(21) Appl. No.: 11/880,363

(22) Filed: Jul. 20, 2007

(65) Prior Publication Data

US 2009/0019720 A1 Jan. 22, 2009

(51) Int. Cl.
*F26B 3/06* (2006.01)
*F26B 17/10* (2006.01)
*F23C 15/00* (2006.01)

(52) U.S. Cl. ..... 34/365; 34/579; 34/582

(58) Field of Classification Search ..... 34/365, 34/579, 582; 431/181, 187, 346, 350, 202
See application file for complete search history.

(56) References Cited

U.S. PATENT DOCUMENTS

| | | | | |
|---|---|---|---|---|
| 1,329,559 | A | 2/1920 | Tesla | |
| 3,667,234 | A | 6/1972 | De Lizasoain | |
| 3,994,671 | A * | 11/1976 | Straitz, III | 431/202 |
| 4,033,120 | A * | 7/1977 | Kentfield | 60/249 |
| 4,128,389 | A * | 12/1978 | Straitz, III | 431/202 |
| 4,652,233 | A * | 3/1987 | Hamazaki et al. | 431/202 |
| 4,667,654 | A | 5/1987 | Thaler et al. | |
| 5,133,297 | A * | 7/1992 | Mansour | 122/4 D |
| 5,209,821 | A | 5/1993 | Shaw et al. | |
| 5,303,275 | A | 4/1994 | Kobsa | |
| 5,637,192 | A | 6/1997 | Mansour et al. | |
| 5,842,289 | A | 12/1998 | Chandran et al. | |

FOREIGN PATENT DOCUMENTS

| | | | |
|---|---|---|---|
| JP | 60207811 | A * | 10/1985 |
| JP | 2006090571 | A * | 4/2006 |

OTHER PUBLICATIONS

Kudra, T., et al., Chapter 14—Pulse Combustion Drying, Advanced Drying Technologies, 2002, pp. 211-237, Marcel Dekker, Inc., New York, USA.

Valveless Pulse Jet, Wikipedia, Feb. 17, 2009 (date retrieved from the Internet), 7 pages, (Retrieved from the Internet URL: http://en.wikipedia.org/wiki/Valveless_pulse_jet).

Zbicinski, I., et al., Application of Pulse Cumbustion Technology in Spray Drying Process, Brazilian Journal of Chemical Engineering, Dec. 2000, 12 pp. vol. 17, No. 4-7, (Retrieved from the Internet URL: http://scielo.br/scielo.php?script=sci_arttext&pld.S0104-66322000000400009).

* cited by examiner

*Primary Examiner* — Jiping Lu
(74) *Attorney, Agent, or Firm* — Ben Armitage; Clise, Billion & Cyr, P.A.

(57) ABSTRACT

The present inventions relate to pulse combustion dryer apparatus and associated methods. The pulse combustion dryer apparatus may include a combustor that defines a combustion chamber that is in fluid communication with a tailpipe passage defined by a tailpipe. An air inlet communicates air into the combustion chamber through an air inlet passage. A fluid diode disposed within the air inlet passage allows airflow into the combustion chamber through the air inlet passage, and may generally prevent backflow of heated combustion products from the combustion chamber through the air inlet passage.

19 Claims, 6 Drawing Sheets

PULSE COMBUSTION DRYER APPARATUS AND METHODS

BACKGROUND OF THE INVENTION

1. Field of the Invention

The present inventions relate to apparatus and methods for drying materials, and, more particularly, to apparatus and methods for pulse combustion drying.

2. Background of the Related Art

The typical pulse combustion dryer includes a combustor connected to a tailpipe. The combustor defines a combustion chamber. Fuel and air may be admitted into the combustion chamber through an air inlet and fuel inlet, respectively, and the resulting fuel-air mixture periodically ignited to propel pulses of heated combustion products through the tailpipe from the combustion chamber. The term "pulse combustion" thus originates from the periodic ignition of solid, liquid, or gaseous fuel to generate pulses of heated combustion products, in contrast to the continuous ignition of fuel in conventional dryers. The material to be dried may be introduced into the pulses of heated combustion products typically in the tailpipe and/or in a drying chamber in fluid communication with the tailpipe.

Some pulse combustion dryers may include a mechanical valve such as a reed valve, flapper valve, or rotary valve to provide a physical barrier to prevent backflow of heated combustion products through the air inlet. However, mechanical valves may be mechanically complex, may require maintenance, and may be prone to failure due to, for example, mechanical stresses, thermal stresses, fatigue, and corrosion by the heated combustion products. Rotary valves may require a feed back control system to synchronize the rotation of the rotary valve with the frequency of the combustion cycle.

A fluid diode may also be used to control flow through the air inlet of the pulse combustion dryer. The fluid diode generally allows airflow relatively freely through the air inlet into the combustion chamber, and generally prevents backflow of heated combustion products from the combustion chamber through the air inlet. This flow direction asymmetry is achieved without moving parts, which may avoid some of the problems associated with mechanical valves. However, pulse combustion dryers that use fluid diodes to control backflow of heated combustion products through the air inlet may still experience some backflow of heated combustion products through the air inlet.

Accordingly, a need exists for improved pulse combustion dryers that may avoid the shortcomings noted above.

SUMMARY OF THE INVENTION

Apparatus and methods in accordance with the present inventions may resolve many of the needs and shortcomings discussed above and may provide additional improvements and advantages that may be recognized by those skilled in the art upon review of the present disclosure.

The present inventions provide a pulse combustion dryer apparatus that includes a tailpipe, a combustor, an air inlet, and a fluid diode. The tailpipe defines a tailpipe passage and the air inlet defines an air inlet passage. The combustor defines a combustion chamber in fluid communication with the air inlet passage to receive airflow through the air inlet passage. The combustion chamber is in fluid communication with the tailpipe passage to expel pulses of heated combustion products through the tailpipe passage. The fluid diode may be disposed within the air inlet passage to allow airflow through the air inlet passage into the combustion chamber and to generally prevent backflow of heated combustion products through the air inlet passage from the combustion chamber. The fluid diode includes one or more vanes, an outer body, and an inner body. The outer body defines an outer body wall. The inner body defines a first inner body wall and a second inner body wall, and the inner body is disposed with respect to the outer body such that the first inner body wall and the outer body wall define an outer passage to communicate airflow from a diode first end to a diode second end. The one or more vanes are secured to the first inner body wall to extend into the outer passage to allow airflow from the first diode end to the second diode end and to generally prevent backflow from the second diode end to the first diode end. The second inner body wall defines, at least in part, an inner passage. One or more inlet ports are disposed about the inner body to admit airflow into the inner passage, and one or more outlet ports are disposed about the inner body to disperse airflow from the inner passage about the one or more vanes in the outer passage to create eddies and cross-flow.

Methods in accordance with aspects of the present inventions may include providing one or more vanes, providing an outer body, the outer body defining an outer body wall, and providing an inner body, the inner body defining a first inner body wall and a second inner body wall, the second inner body wall defining, at least in part, an inner passage. The methods may include disposing the outer body and the inner body with respect to one another thereby defining an outer passage by the outer body wall and the first inner body wall, and securing the one or more vanes to the first inner body wall, the one or more vanes extending into the outer passage. The methods may include disposing one or more inlet ports about the inner body to allow the inner passage to receive airflow, and disposing one or more outlet ports about the inner body to distribute airflow about the one or more vanes from the inner passage. The methods may include forming a fluid diode, disposing the fluid diode in an air inlet passage of a pulse combustion dryer having a combustion chamber. The methods may include admitting airflow into the inner passage through the one or more inlet ports, and distributing airflow from the inner passage into the outer passage through the one or more outlet ports thereby creating eddies and cross-flow in the outer passage.

Other features and advantages of the inventions will become apparent from the following detailed description, and from the claims.

Figure 1A:
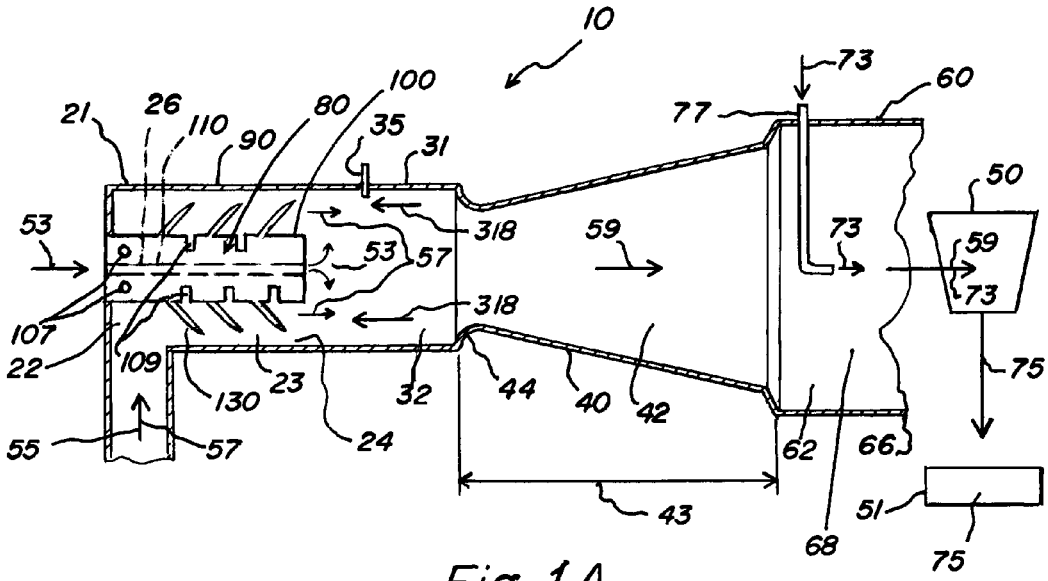
FIG. 1A illustrates by schematic diagram an exemplary embodiment of a pulse combustion dryer apparatus in accordance with aspects of the present inventions.

All Figures are illustrated for ease of explanation of the basic teachings of the present invention only; the extensions of the Figures with respect to number, position, relationship and dimensions of the parts to form the preferred embodiment will be explained or will be within the skill of the art after the following description has been read and understood. Further, the dimensions and dimensional proportions to conform to specific force, weight, strength, and similar requirements for various applications will likewise be within the skill of the art after the following description has been read and understood.

Where used in various Figures of the drawings, the same numerals designate the same or similar parts. Furthermore, when the terms "upper," "lower," "right," "left," "forward," "rear," "first," "second," "inside," "outside," "front," "back," and similar terms are used, the terms should be understood to reference only the structure shown in the drawings and utilized only to facilitate describing the illustrated embodiments.

DETAILED DESCRIPTION OF THE INVENTION

The present inventions provide a pulse combustion dryer apparatus 10 for the drying of a dryer feed material 73. The pulse combustion dryer apparatus 10 may include a combustor 31, an air inlet 21, a fluid diode 80, and a tailpipe 40. The combustor 31 defines a combustion chamber 32, and the air inlet 21 is in fluid communication with the combustion chamber 32 to communicate air 55 into the combustion chamber 32. The fluid diode 80 is included within the air inlet 21 to regulate flow through the air inlet by allowing airflow 57 through the air inlet 21 into the combustion chamber 32 and generally preventing backflow 318 from the combustion chamber 32 through the air inlet 21. The pulse combustion dryer 10 may include the tailpipe 40 that defines a tailpipe passage 42 that fluidly communicates with the combustion chamber 32. The combustion chamber 32 is configured to receive a pulse of airflow 57 admitted through the air inlet 21 and a pulse of fuel 53, and to ignite periodically the fuel-air mixture to produce pulses of heated combustion products 59, which may be expelled through the tailpipe passage 42.

The dryer feed material 73 may be introduced into the pulses of heated combustion products 59 to generally dry the dryer feed material 73 into dried material 75 by evaporation and/or mechanical stripping of water from the dryer feed material 73. The dried material 75 is drier than, and may be substantially drier than, the dryer feed material 73. In some aspects, substantially all of the water may be removed from the dried material 75, while, in other aspects, some residual amount of water may be retained in the dried material 75. The dried material 75 may be communicated along with the heated combustion products 59 into a collector 50, which may be configured to recover the dried material 75.

The fluid diode 80 within the air inlet 21 generally prevents the backflow 318 of heated combustion products 59 through the air inlet 21 while allowing airflow 57 through the air inlet 21 into the combustion chamber 32 to replenish the air 55 in the combustion chamber 32 between pulses. In various aspects, the fluid diode 80 may be configured to induce eddies 312 and cross-flows 314 into the airflow 57 to prevent backflow 318. In various aspects, the fluid diode 80 may be configured to distribute fuel 53 into the airflow 57 including turbulence resulting from eddies 312 and cross-flows 314 in order to mix the fuel 53 with air 55 to produce the fuel-air mixture in the combustion chamber 32.

The Figures generally illustrate exemplary embodiments of the pulse combustion dryer apparatus 10 in accordance with aspects of the present inventions. The particularly illustrated embodiments of the pulse combustion dryer apparatus 10 have been chosen for ease of explanation and understanding of various aspects of the present inventions. These illustrated embodiments are not meant to limit the scope of coverage but, instead, to assist in understanding the context of the language used in this specification and in the appended claims. Accordingly, the appended claims may encompass variations of the present inventions that differ from the illustrated embodiments.

The pulse combustion dryer apparatus 10 according to the present inventions generally includes the combustor 31, the air inlet 21 with fluid diode 80, and the tailpipe 40. The combustor 31 defines the combustion chamber 32 in which fuel 53 may be combined with air 55 and the resulting fuel-air mixture ignited. One or more igniters 35 may be disposed about the combustor 31 to extend into the combustion chamber 32 in order to ignite the fuel-air mixture within the combustion chamber 32. One or more fuel inlets 26 configured to admit fuel 53 into the combustion chamber 32 may be disposed about the combustor 31. The fuel 53 may be solid, liquid, or gaseous, or combinations thereof. For example, the fuel 53 could be natural gas, propane, or fuel oil in various aspects.

One or more air inlets 21 may be disposed about the combustor 31 to communicate airflow 57 into the combustion chamber 32 in order to replenish the air 55 in the combustion chamber 32 following an ignition. The air inlet 21 may define an air inlet passage 23 having a first air inlet end 22 and a second air inlet end 24. The first air inlet end 22 may fluidly communicate with an air source, which may be an ambient and/or a pressurized source, to communicate air 55 into the air inlet passage 23 through the first air inlet end 22. The second air inlet end 24 may fluidly communicate with the combustion chamber 32 to communicate air 55 from the air inlet passage 23 into the combustion chamber 32. Accordingly, airflow 57 may be communicated from the air source into the combustion chamber 32 through the air inlet passage 23.

The fluid diode 80 may be disposed within the air inlet passage 23 to allow airflow 57 through the air inlet passage 23 into the combustion chamber 31 and to generally prevent the backflow 318 of combustion products 59 from the combustion chamber 32 through the air inlet passage 23.

The fluid diode 80 according to the present inventions has a first end 94 and a second end 96, with the first end 94 oriented toward the air inlet first end 22 and the second end 96 oriented toward the air inlet second end 24. The fluid diode 80, in various aspects, may include an outer body 90 and an inner body 100 to define an outer passage 91 to communicate airflow 57 through the fluid diode 80 generally from the diode first end 94 to the diode second end 96 and, thence, into the combustion chamber 32. One or more vanes 130 may be secured to the inner body 100 circumferentially and extended into the outer passage 91 to prevent backflow 318 of combustion products 59 out of the combustion chamber 32 through the fluid diode 80 from the diode second end 96 to the diode first end 94.

The inner body 100 defines an inner passage 101 to receive airflow 57 and to distribute airflow 57 generally about the one or more vanes 130. One or more inlet ports 107 may be disposed about the inner body 100 typically generally proximate the diode first end 94 to admit airflow into the inner passage 101, and one or more outlet ports 109 may be disposed about the inner body 100 to distribute airflow 57 from the inner passage 101 into the outer passage 91 to create eddies 312 and cross-flow 314 about the one or more vanes 130, which may generally enhance the prevention of backflow 318 through the outer passage 91 of the fluid diode 80.

In various aspects, the outer body 90 defines an outer body wall 95 and the inner body 100 defines a first inner body wall 103 and a second inner body wall 105. The outer body 90 and the inner body 100 may be disposed with respect to each other so that the outer body wall 95 and the first inner body wall 103 define the outer passage 91 to communicate airflow 57 generally from the diode first end 94 to the diode second end 96.

The outer passage 91 may have various configurations that may depend upon the configuration of the outer body 90 and the inner body 100. For example, in some aspects, the outer body 90 and the inner body 100 may be generally cylindrical in shape to define a generally annular outer passage 91 by the outer body wall 95 and the first inner body wall 103. In other aspects, the outer body 90 and the inner body 100 may be frusto-conical to define an outer passage 91 with radius either increasing or decreasing between the diode first end 94 and the diode second end 96 by the outer body wall 95 and the first inner body wall 103. In still other aspects, for example, the outer body 90 may be generally cylindrical and the inner body 100 frusto-conical to define an outer passage 91 with either a converging area or a diverging area by the outer body wall 95 and the first inner body wall 103. The outer body 90 and the inner body 100 may be configured in various other ways to define various other outer passages 91 by the outer body wall 95 and the first inner body wall 103 as would be recognized by those of skill in the art upon review of this disclosure.

The second inner body wall 105 defines the inner passage 101. In some aspects, one or more inlet ports 107 may be disposed about the inner body 100 typically generally proximate the diode first end 94 to admit airflow 57 into the inner passage 101 from the outer passage 91. In other aspects, one or more inlet ports 107 may be disposed about the inner body 100 to admit air 55 into the inner passage from a compressed air source 220.

One or more vanes 130 may be secured to the first inner body wall 103. The one or more vanes 130 may extend from the first inner body wall 103 toward the outer body wall 95, and the one or more vanes may wrap circumferentially around the outer passage 91. The one or more vanes 130 may be generally configured to form a cascade, and a gap 140 may be maintained between a vane tip 138 and the outer body wall 95 to allow airflow 57 about the cascade through one or more gaps 140 from the diode first end 94 to the diode second end 96. The one or more vanes 130 are typically angled toward the diode second end 94 at a wall angle 147 to allow airflow 57 through the outer passage 91 from the diode first end 94 to the diode second end 96 relatively unimpeded except by surface friction, while generally inhibiting backflow 318 from the diode second end 96 to the diode first end 94 by forming a series of expansions, contractions, deflections and other barriers to backflow 318. In various aspects having a plurality of vanes 130, the vanes 130 may be set at the same wall angle 147 or may be set with varying wall angles 147. The vanes 130 in a plurality of vanes 130 may have the same geometric shape or may have varying geometric shapes. In some aspects, the one or more vanes 130 may be essentially flat plates, while in other aspects the one or more vanes 130 may be configured to have airfoil shapes. The one or more vanes 130 have camber 141. The camber 141 may be essentially zero in some aspects, and the camber 141 may vary from vane 130 to vane 130 in certain aspects. In aspects having a plurality of vanes 130, the vanes may be disposed at constant offsets 143 as measured from chord 142 to chord 142 about the first inner body wall 103, or the offsets 143 may be varied. In some aspects, the offsets 143 may be variable so that the offsets 143 may be increased or decreased to adjust for the airflow 57 through the outer passage 91. The one or more vanes 130 may be otherwise configured and disposed about the first inner body wall 103 as would be recognized by those of skill in the art upon review of this disclosure.

The vane 130 defines a first vane surface 132, which is the portion of the surface of the vane 130 generally proximate the diode first end 94 and a second vane surface 134 which is the portion of the surface of the vane generally proximate the diode second end 96. A region 150 may be defined by the second vane surface 134 of the first vane 130 and may be further defined by the first vane surface 132 of the second vane 130 where the second vane 130 is positioned more proximate the second diode end 96 than the first vane 130. One or more outlet ports 109 may be disposed about the inner body 100 to distribute air from the inner passage 101 into the outer passage 91 particularly into one or more regions 150 to create eddies 312 and cross-flow 314. These eddies 312 and cross-flow 314 may create turbulence and generally interfere with backflow 318 through the fluid diode 80, which may enhance the effectiveness of the fluid diode 80.

In some aspects, the fluid diode 80 may include an inner sleeve 110 to form at least portions of the fuel inlet 26. The inner sleeve 110 may have a first inner sleeve wall 113 and a second inner sleeve wall 115. The inner sleeve 110 may be interposed with the inner body 100 so that the first inner sleeve wall 113 and the second inner body wall 105 define the inner passage 101 to distribute airflow about the cascade of vanes 130. The inner passage 101 may be generally annular or may have various other cross-sectional shapes. The second inner sleeve wall 115 may define a sleeve passage 111 with a first sleeve passage end 112 and a second sleeve passage end 114 to communicate fuel 53. The first sleeve passage end 112 may be in fluid communication with a fuel source and the second sleeve passage end 114 may be in fluid communication with the combustion chamber 32 to communicate fuel 53 from the fuel source into the sleeve passage 111 through the first sleeve passage end 112 and into the combustion chamber 32 through the second sleeve passage end 114. The sleeve passage 111 typically has a generally circular cross-section, but other cross-sections could be used in various aspects. Various structures in communication with the sleeve passage second end 114 may be included generally near the diode second end 96 to distribute the fuel 53 into the airflow 57 typically proximate the diode second end 96. The turbulence produced by the eddies 312 and the cross-flow 314 may aid in the mixing of the fuel 53 into the airflow 57, and the combined fuel-air mixture may pass into the combustion chamber 32 for ignition.

The tailpipe 40 defines a tailpipe passage 42 with a first end 44 and a second end 46. The first end 44 of the tailpipe 40 is connected to the combustion chamber 32 so that the tailpipe passage 42 is in fluid communication with the combustion chamber 32 to communicate combustion products 59 from the combustion chamber 32 into the tailpipe passage 42 at the first end 44 and through the tailpipe passage 42 from first end 44 to second end 46. The tailpipe 40 is typically flared so that the cross-sectional area of the tailpipe passage 42 generally increases from the first end 44 to the second end 46 to accelerate the combustion products 59. In some aspects, the second end 46 of the tailpipe 40 may be connected to a collector 50 so that the tailpipe passage 42 is in fluid communication with the collector 50. Dryer feed material 73 may then be introduced into the tailpipe passage 42 through one or more feed inlets 77 configured for that purpose to be entrained in combustion products 59 communicated through the tailpipe passage 42 from the combustion chamber 32. The combined combustion products 59 and drier feed material 73 may be communicated into the collector 50 for collection of the now dried material 75 from the combustion products 59.

In other aspects, the second end 46 of the tailpipe 40 may be connected to a drying chamber 60. The drying chamber 60 defines a drying chamber passage 62 with a first drying chamber end 64 and a second drying chamber end 66. The first drying chamber end 64 may be secured generally about the second end 46 of the tailpipe 40 so that the tailpipe passage 42 is in fluid communication with the drying chamber passage 62 to communicate combustion products 59 from the tailpipe passage 42 into the drying chamber passage 62. Dryer feed material 73 may then be introduced into the drying chamber passage 62 through one or more feed inlets 77 configured for that purpose, to be entrained in combustion products 59 communicated through the drying chamber passage 62. The second drying chamber end 66 may be connected to the collector 50 to communicate the combined combustion products 59 and drier feed material 73 into the collector 50 for collection of the now dried material 75. The collector 50 may be configured as a cyclone, filter, baghouse, or similar, or combinations thereof.

The combustor 31 and the tailpipe 40 are typically subjected to elevated temperatures. At least portions of the air inlet 21 including the fluid diode 80 may also be subjected to elevated temperatures. Thus, the combustor 31, the tailpipe 40, and the air inlet 21 including the fluid diode 80 may be composed, at least in part, of high temperature ceramic materials such as Silicon Nitride, Silicon Carbide, Alumina Oxide, or Mullite-type ceramics and combinations thereof. In some aspects, the surfaces of the ceramic materials may be surfaced with catalytic metals such as platinum and nickel to improve the combustion process and reduce pollution. For example, portions of the combustor 31 that define the combustion chamber 32 may be surfaced with catalytic metals, which may improve combustion in the combustion chamber 32. The combustor 31, the tailpipe 40, and the air inlet 21 including the fluid diode 80 may also be composed, at least in part, of high temperature stainless steel such as Inconel. The high temperature stainless steel may be lined with ceramics such as those described above and/or coated with high temperature Zirconia based coatings. The Zirconia based coating is typically about 10-15 thousandths of an inch thick. Various combinations of the above materials may be used as well as other materials recognized by those skilled in the art upon review of this disclosure.

The pulse combustion dryer apparatus 10 may be configured as a Helmholtz resonator or other resonator to ignite the fuel-air mixture periodically in the combustion chamber 32, in contrast to the continuous ignition in conventional dryers. In operation, the fuel-air mixture in the combustion chamber 32 may be ignited to produce compression in the combustion chamber 32 and a compression wave that propagates through the tailpipe passage 42 from the first end 44 to the second end 46. The fluid diode 80 generally prevents backflow 318 of heated combustion products 59 driven by the compression in the combustion chamber 32 from passing through the air inlet passage 23. The air inlet passage 23 configured to include the fluid diode 42 may relieve the compression in the combustion chamber 32 to produce a corresponding rarefaction in the combustion chamber 32, and the fluid diode 42 may allow airflow 57 through the air passage 21 to, at least in part, replenish the air 55 in the combustion chamber 32. The airflow 57 through the air passage 21 may be driven by the rarefaction in the combustion chamber 32. Rarefaction in the combustion chamber 32 may also serve to draw fuel 53 into the combustion chamber 32 through the fuel inlet 26, while the compression in the combustion chamber 32 may inhibit the introduction of fuel 53 into the combustion chamber 32 through the fuel inlet 26.

The compression wave may pass through the tailpipe passage 42 to be followed by a rarefaction wave that propagates through the tailpipe passage 42 from the second end 46 to the first end 44 to draw air 55 and combustion products 59 generally through the tailpipe passage 42 from the second end 46 to the first end 44 and, thence, into the combustion chamber 32. The rarefaction wave through the tailpipe passage 42 may, in part, replenish the air 55 in the combustion chamber 32 and may also provide an ignition source for subsequent ignitions by drawing heated combustion products 59 back into the combustion chamber 32. Thus, the tailpipe length 43 of the tailpipe 40 may be sized to control the period between ignitions by controlling the period of the compression wave and rarefaction wave.

The pulse combustion dryer 30 periodically ignites fuel 53 to generate pulses of heated combustion products 59 that pass thru the drying chamber passage 68. In various aspects, the drying passage 68 may include the tailpipe passage 42, may include the drying chamber passage 62, or may include both the tailpipe passage 42 and the drying chamber passage 62. Dryer feed material 73 may be introduced into the drying passage 68 to be entrained in the combustion products 59 and dried. The drying passage 68 may be in communication with a collector 50 to communicate the dryer feed material 73 and combustion products 50 into the collector for collection of the now dried material 75.

Referring now to the Figures, an embodiment of the pulse combustion dryer apparatus 10 according to the present inventions that includes the combustor 31, the tailpipe 40, and the drying chamber 60 are generally illustrated in FIG. 1A. As illustrated in this embodiment, the drying passage 68 includes the drying chamber passage 62. The pulse combustion dryer 30, in this embodiment, includes feed inlet 77 to allow the introduction of dryer feed material 73 into the drying passage 68.

The combustor 31 defines the combustion chamber 32, as illustrated. The combustion chamber 32 may receive a pulse of air 55 and a pulse of fuel 53 communicated through air inlet 21 and fuel inlet 26, respectively, and ignite the resulting fuel-air mixture to produce the pulse of heated combustion products 59. The igniter 35 is provided to ignite the fuel-air mixture in the combustion chamber 32.

As illustrated in FIG. 1A, the tailpipe 40 defines the tailpipe passage 42. The tailpipe passage 42 is in fluid communication with the combustion chamber 32 to receive the pulse of combustion products 59 from the combustion chamber 32, and the combustion products 59 may be communicated through the tailpipe passage 42 from first end 44 to second end 46. The second end 46 of the tailpipe passage 42 is in fluid communication with the first drying chamber end 64 of the drying chamber passage 62 in this embodiment to communicate the combustion products 59 from the tailpipe passage 42 into the drying chamber passage 62.

As illustrated in FIG. 1A, the dryer feed material 73 may be introduced into the drying chamber passage 62, which constitutes the drying passage 68 in this embodiment, through one or more feed inlets 77 to be entrained in pulses of combustion products 59 passing through the drying chamber passage 62 from the first drying chamber end 64 to the second drying chamber end 66. The second drying chamber end 66 is in fluid communication with the collector 50 to communicate the now dried material 75 into the collector 50, and the collector 50 is configured to capture the dried material 75. As illustrated, the collector 50 may place the dried material into a bin 51. Other embodiments of the pulse combustion dryer apparatus 10 may include only the tailpipe 40 in which case the tailpipe passage 42 constitutes the drying passage 68. In such embodiments, one or more feed inlets 77 may be disposed about the tailpipe 40 to introduce the dryer feed material into the tailpipe passage 42. The second end 46 of the tailpipe passage 42 may communicate with the collector 50 so that the collector 50 may capture the dried material 75.

Figure 1B:
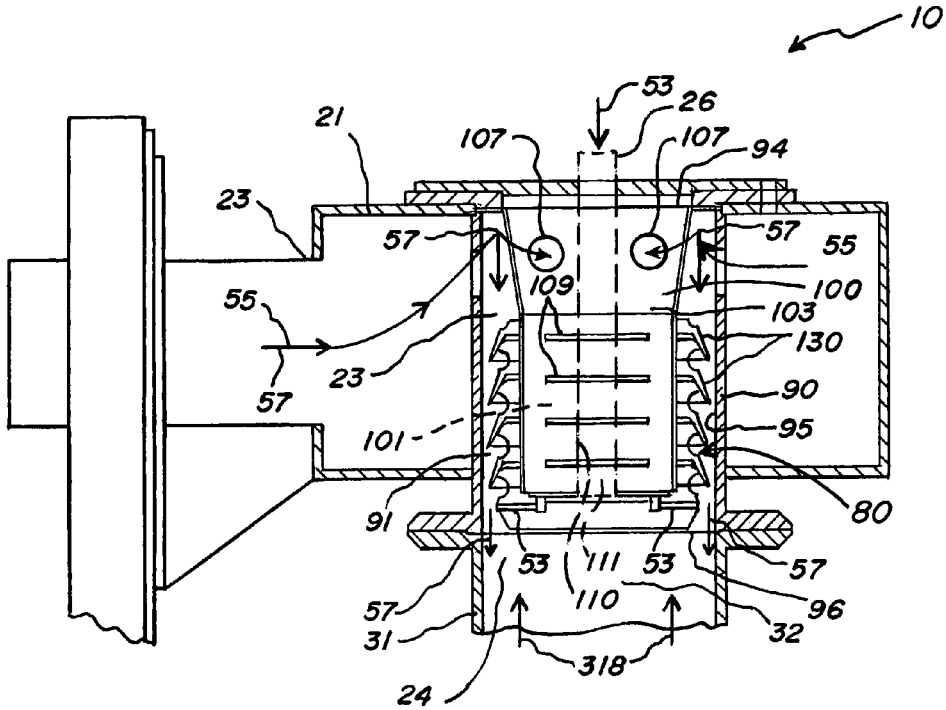
FIG. 1B illustrates a cut-away view of an exemplary embodiment of the air inlet in accordance with aspects of the present inventions.

As illustrate in FIG. 1A, the air inlet passage 23 includes the fluid diode 80 to allow the communication of airflow 57 through the air inlet passage 23 into the combustion chamber 32 and generally prevent backflow 318 from the combustion chamber through the air inlet passage 23. This embodiment of the air inlet 21 including the fluid diode 80 is illustrated in more detail in FIG. 1B. As illustrated in FIG. 1B, the air inlet 21 defines air inlet passage 23 to communicate airflow 57 into the combustion chamber 32. The airflow 57 may be communicated from an airflow source into the air inlet passage 23 through the first air inlet end 22 and into the combustion chamber 32 through the second air inlet end 24 to replenish the air 55 in the combustion chamber 32 following an ignition.

The fluid diode 80 may be positioned in the air inlet passage 23, as illustrated in FIG. 1B, to allow airflow 57 into the combustion chamber 32 through the air inlet passage 23 and generally prevent backflow 318 from the combustion chamber 32 through the air inlet passage 23. Portions of the air inlet 21 form the outer body 91 in the illustrated embodiment. The fluid diode 80, as illustrated, includes the inner body 100. The outer body wall 95 and the first inner body wall 103 of the inner body 100 define the outer passage 91 to communicate airflow 57 through the fluid diode 80 generally from the diode first end 94 to the diode second end 96 and, thus, communicate airflow 57 generally from the first air inlet end 22 to the second air inlet end 24 and into the combustion chamber 32. A number of vanes 130 may be secured to the first inner body wall 103 of the inner body 100 configured to generally prevent backflow 318 through the outer passage 91 from the diode second end 96 to the diode first end 94, and, thus, generally prevent backflow 318 from the combustion chamber 32 through the air inlet passage 23 from the second air inlet end 24 to the first air inlet end 22.

The inner body 100 defines the inner passage 101 configured to receive airflow 57 and to distribute airflow 57 generally about the vanes 130. As illustrated, one or more inlet ports 107 may be disposed about the inner body 100 to allow airflow 57 to enter the inner passage 101 from the outer passage 91 and/or various other portions of the air inlet passage 23. The inlet ports 107 are typically positioned generally proximate the diode first end 94. As illustrated, the inlet ports 107 may be generally circular, although other shapes such as rectangular slits or ovals and combinations of shapes could be used for the inlet ports 107. The inlet ports 107 may be disposed circumferentially about the inner body 100 generally proximate the diode first end 94, and the airflow 57 may be distributed generally circumferentially about the diode first end 94 to be generally uniformly received into the inner passage 101 through the inlet ports 107.

As illustrated in FIG. 1B, one or more outlet ports 109 may be disposed about the inner body 100 to distribute airflow 57 from the inner passage 101 about the one or more vanes 130 in the outer passage 91 in order to create eddies 312 and cross-flows 314 in the outer passage 91. The outlet ports 109 may be configured as rectangular slits, as illustrated, but other shapes such as circular and oval and combinations of shapes could also be used for the outlet ports 109.

As illustrated in FIG. 1B, the fluid diode 80 may include inner sleeve 110 that defines sleeve passage 111 to communicate fuel 53 into the combustion chamber 32 from a fuel source thereby forming at least a portion of the fuel inlet 26. The fuel 53 may be distributed into the airflow 57 generally proximate the diode second end 96 as illustrated, and the turbulence produced by the eddies 312 and the cross-flow 314 may aid in the mixing of the fuel 53 into the airflow 57 to produce the fuel-air mixture in the combustion chamber 31.

Figure 2A:
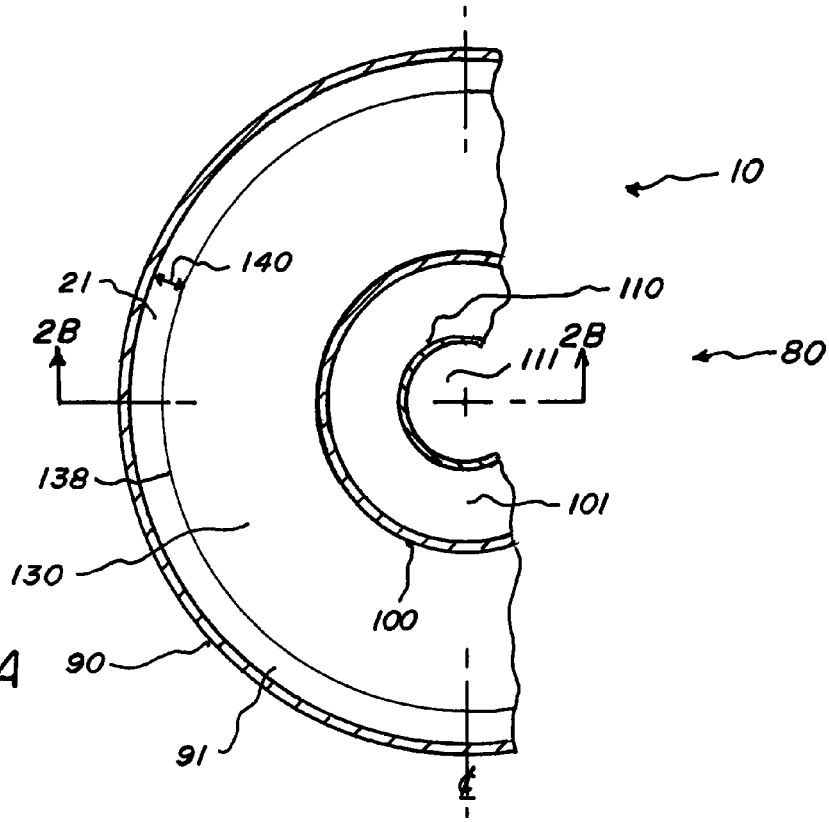
FIG. 2A illustrates a cut-away top view of an exemplary embodiment of the fluid diode in accordance with aspects of the present inventions.
Figure 2B:
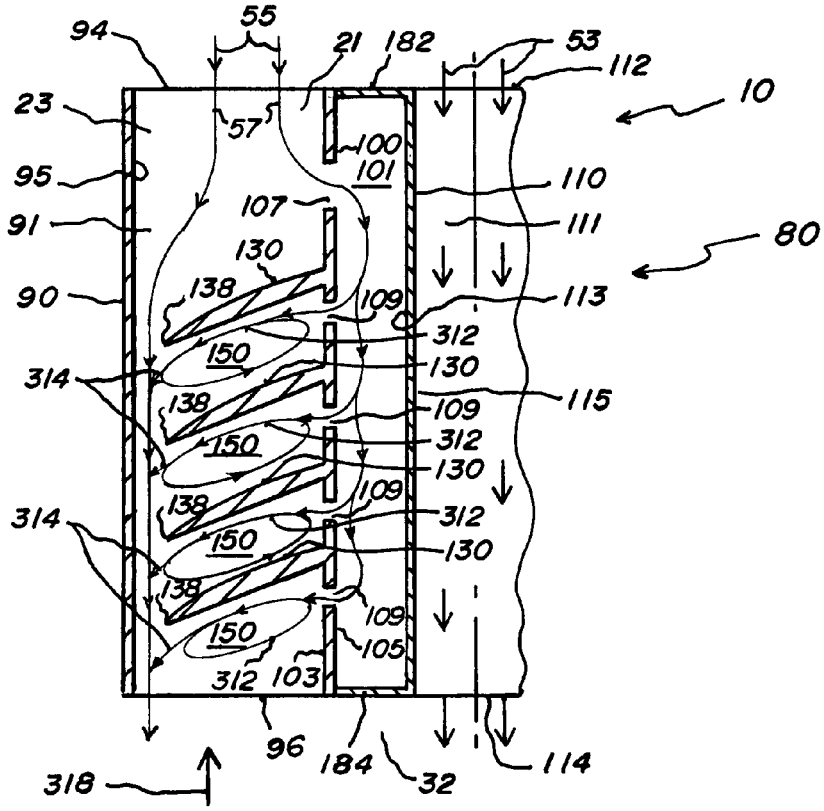
FIG. 2B illustrates a cut-away side view of an exemplary embodiment of the fluid diode in accordance with aspects of the present inventions generally corresponding to the embodiment illustrated in FIG. 2A.

FIGS. 2A and 2B generally illustrate an embodiment of the fluid diode 80 according to the present inventions. The fluid diode 80, as illustrated, includes an outer body 90, an inner body 100, and an inner sleeve 110 to define passages to convey air 55 and fuel 53 through the fluid diode 80 generally from the diode first end 94 to the diode second end 96 and, thence, into the combustion chamber 32, while preventing backflow 318 of combustion products 59 out of the combustion chamber 32 through the fluid diode 80 from the diode second end 96 to the diode first end 94.

In the embodiment illustrated in FIGS. 2A and 2B, the outer body 90 defines an outer body wall 95, the inner body 100 defines a first inner body wall 103 and a second inner body wall 105, and the inner sleeve 110 defines a first inner sleeve wall 113 and a second inner sleeve wall 115. The outer body 90 and the inner body 100 may be disposed with respect to each other so that the outer body wall 95 and the first inner body wall 103 define an annular outer passage 91 to communicate airflow 57 generally from the diode first end 94 to the diode second end 96. The inner body 100 and the inner sleeve 110 may be disposed with respect to each other so that the second inner body wall 105 and the first inner sleeve wall 113 define an inner passage 101 to receive airflow 57 generally proximate the diode first end 94 and to distribute the airflow 57 about the one or more vanes 130. One or more inlet ports 107 may be disposed about the inner body 100 typically generally proximate the diode first end 94 to admit airflow 57 into the inner passage 101 from the outer passage 91, as illustrated in FIG. 2B.

One or more vanes 130 may be secured to the first inner body wall 103. The one or more vanes 130 may extend from the first inner body wall 103 toward the outer body wall 95, and the one or more vanes 130 may extend circumferentially around the outer passage 91, as illustrated. The gap 140 between vane tip 138 and the outer body wall 95 allows airflow 57 from the diode first end 94 to the diode second end 96. The one or more vanes 130 may be set at a wall angle 147 configured to allow airflow 57 through the outer passage 91 from the diode first end 94 to the diode second end 96, as illustrated, while generally preventing backflow 318 from the diode second end 96 to the diode first end 94. The vane 130 defines a first vane surface 132, which is the portion of the vane surface generally proximate the diode first end 94, and a second vane surface 134 which is the portion of the vane surface generally proximate the diode second end 96. A region 150 may be generally defined by the second vane surface 134 of the first vane 130 and may be further generally defined by the first vane surface 132 of the second vane 130 where the second vane 130 is positioned more proximate the second diode end 96 than the first vane 130, as illustrated. One or more outlet ports 109 may be disposed about the inner body 100 to distribute airflow 57 from the inner passage 101 into the outer passage 91 particularly into one or more regions 150 to create eddies 312 and cross-flow 314, as illustrated in FIG. 2B. The eddies 312 and cross-flow 314 may interfere with backflow 318 to enhance the effectiveness of the fluid diode 80 at preventing backflow 318. First end cap 182 and second end cap 184 seal the inner passage 101 in the illustrated embodiment so that essentially all of the airflow 57 admitted into the inner passage 101 through inlet ports 107 is distributed into the outer passage 91 through outlet ports 109.

The second inner sleeve wall 115 may define the sleeve passage 111 to communicate fuel 53 generally between the diode first end 94 and the diode second end 96 and into the combustion chamber 32 as illustrated in FIGS. 2A and 2B. The turbulence produced by the eddies 312 and the cross-flow 314 may aid in the mixing of the fuel 53 into the airflow 57 as the fuel 53 passes out of the second sleeve passage end 114 in this embodiment, and the combined fuel-air mixture may be communicated into the combustion chamber 32 to be ignited. Dispersion structures 170 may be included generally near second sleeve passage end 114 in various embodiments to distribute the fuel 53 into the airflow 57 typically generally proximate the diode second end 96.

Figure 3A:
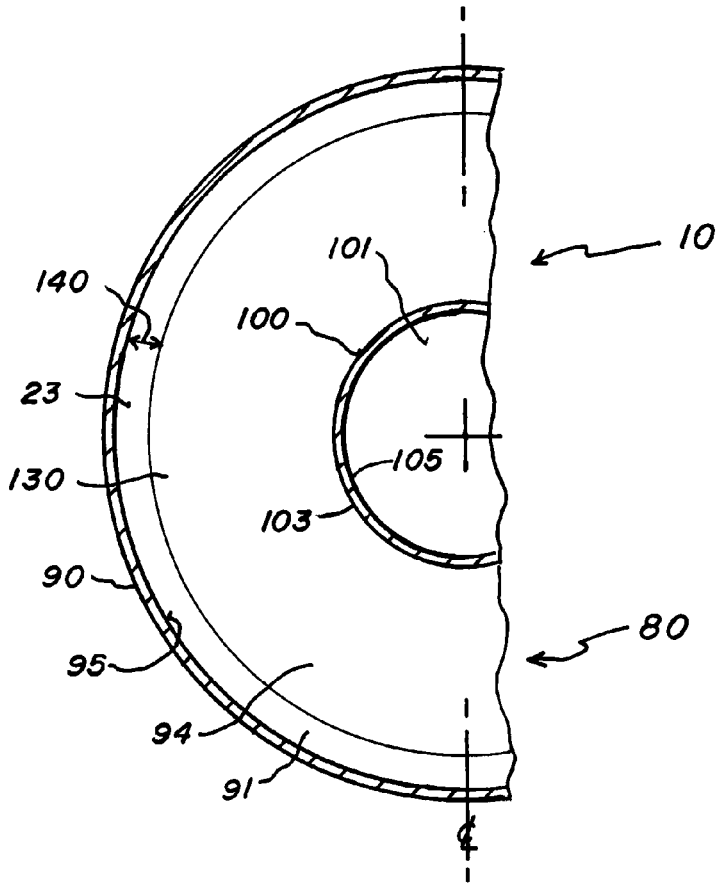
FIG. 3A illustrates a cut-away top view of another exemplary embodiment of the fluid diode in accordance with aspects of the present inventions.
Figure 3B:
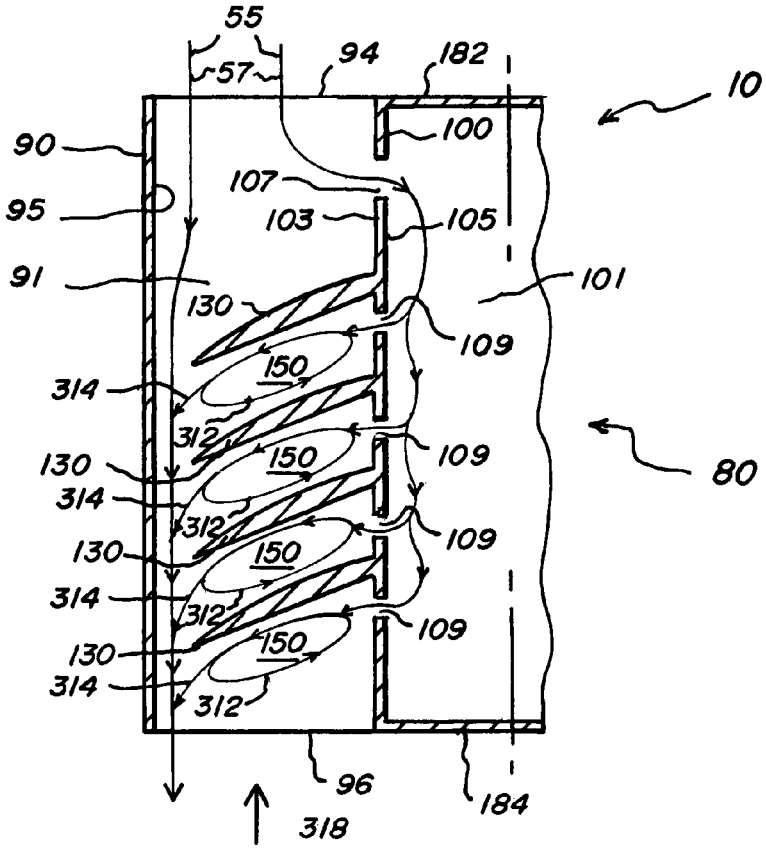
FIG. 3B illustrates a cut-away side view of an exemplary embodiment of the fluid diode in accordance with aspects of the present inventions generally corresponding to the embodiment illustrated in FIG. 3A.

FIGS. 3A and 3B generally illustrate another embodiment of the fluid diode 80 according to the present inventions. The fluid diode 80, as illustrated in this embodiment, includes an outer body 90 and an inner body 100 to define passages to communicate airflow 57 through the fluid diode 80 generally from the diode first end 94 to the diode second end 96 and, thence, into the combustion chamber 31, and prevent backflow 318 of combustion products 59 out of the combustion chamber 32 through the fluid diode 80 from the diode second end 96 to the diode first end 94.

In the embodiment illustrated in FIGS. 3A and 3B, the outer body 90 defines an outer body wall 95, and the inner body 100 defines a first inner body wall 103 and a second inner body wall 105. The outer body 90 and the inner body 100 may be disposed with respect to each other so that the outer body wall 95 and the first inner body wall 103 define the annular outer passage 91 to communicate airflow 57 generally from the diode first end 94 to the diode second end 96. In this embodiment, the second inner body wall 105 of the inner body 100 defines an inner passage 101 to receive airflow 57 generally proximate the diode first end 94 and to distribute the airflow 57 about the one or more vanes 130 that extend into the outer passage 91.

One or more vanes 130 may be circumferentially secured to the first inner body wall 103 to extend from the first inner body wall 103 toward the outer body wall 95, as illustrated, to allow the communication of airflow 57 through the outer passage 91 from the diode first end 94 to the diode second end 96 while generally preventing backflow 318 from the diode second end 96 to the diode first end 94. Inlet ports 107 may be disposed about the inner body 100 generally proximate the diode first end 94 to admit airflow 57 into the inner passage 101 from the outer passage 91, as illustrated in FIG. 3B. The outlet ports 109 are disposed about the inner body 100, in this embodiment, to distribute air from the inner passage 101 into the outer passage 91 particularly into one or more regions 150 to create eddies 312 and cross-flow 314, as illustrated. The eddies 312 and cross-flow 314 and the resulting turbulence may interfere with backflow 318 to generally prevent backflow 318 through the fluid diode 80 in order to enhance the effectiveness of the fluid diode 80.

Figure 4:
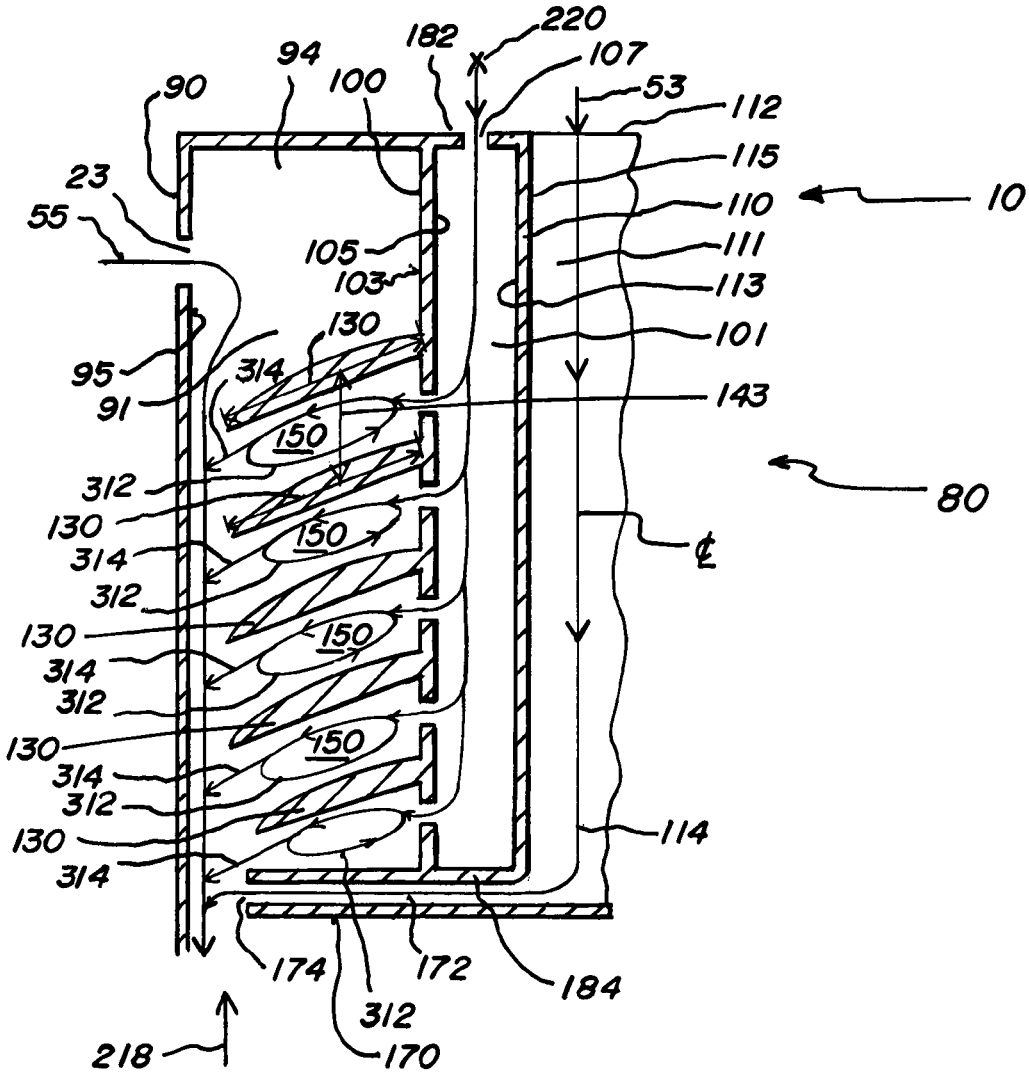
FIG. 4 illustrates a cut-away side view of an exemplary embodiment of the fluid diode in accordance with aspects of the present inventions.

In the embodiment illustrated in FIG. 4, the outer body 90 defines an outer body wall 95, the inner body 100 defines a first inner body wall 103 and a second inner body wall 105, and the inner sleeve 110 defines a first inner sleeve wall 113 and a second inner sleeve wall 115. The outer body 90 and the inner body 100 may be disposed with respect to each other so that the outer body wall 95 and the first inner body wall 103 define an annular outer passage 91 to communicate airflow 57 generally from the diode first end 94 to the diode second end 96. The inner body 100 and the inner sleeve 110 may be disposed with respect to each other such that the second inner body wall 105 and the first inner sleeve wall 113 define an inner passage 101 to receive airflow 57 generally proximate the diode first end 94 and to distribute the airflow 57 about the one or more vanes 130. In this embodiment, one or more inlet ports 107 that communicate with a compressed air source 220 may be disposed about the inner body 100 typically about the first end cap 182 to communicate airflow 57 into the inner passage 101 from the compressed air source 220, as illustrated in FIG. 4. In this embodiment, airflow 57 from compressed air source 220 is additional to the airflow 57 communicated into the air inlet passage 23 at the first air inlet end 22, and airflow 57 from compressed air source 220 is communicated directly into the inner passage 101 through the one or more inlet ports 107.

One or more vanes 130 may be circumferentially secured to the first inner body wall 103. The vanes 130 may extend from the first inner body wall 103 toward the outer body wall 95, and circumferentially around the outer passage 91, as illustrated. The offset 143 between the vanes 130 may be made relatively small to make the region 150 relatively small so that low rates of airflow 157 distributed into region 150 from the inner passage 101 create cross-flow 314 in the region 150 with a relatively high velocity to enhance the diode effect when low rates of airflow 57 pass through the air inlet passage 23. In some embodiments, the offset 143 may be adjustable to make the size of the region 150 adjustable.

As illustrated in FIG. 4, the second inner sleeve wall 115 may define the sleeve passage 111 to communicate fuel 53 generally from the diode first end 94 to the diode second end 96. Dispersion structure 170 may be included generally near the diode second end 96 to distribute the fuel into the airflow 57. In this illustrated embodiment, the dispersion structure 170 defines dispersion passage 172. The sleeve passage 111 fluidly communicates with the dispersion passage 172 generally at the second sleeve passage end 114 to communicate fuel 53 from the sleeve passage 111 into the dispersion passage 172. The dispersion passage 172, as illustrated, includes dispersion outlet 176 to disperse fuel 53 from the dispersion passage 172 into the airflow 57. The dispersion outlet 176 may be configured as a circumferential slit, as illustrated in this embodiment. In various other embodiments, the sleeve passage 111 may, for example, communicate with one or more dispersion passages 172 with one or more dispersion outlets 176 configured as nozzles, orifices, and the like to spray, atomize, and/or otherwise disperse the fuel into the airflow 57. The turbulence that may result from the eddies 312 and cross-flows 314 induced by the distribution of airflow 57 about the vanes 130 from the inner passage 101 may enhance the dispersal of the fuel 53 into the airflow 57 and formation of the fuel-air mixture in the combustion chamber 32. Other dispersion structures 170 may be provided to disperse the fuel 53 into the airflow 57 in various embodiments and the dispersion structures 170 may be oriented in various ways to disperse the fuel 53 into the turbulent airflow 57, as would be recognized by those of skill in the art upon review of this disclosure.

Figure 5:
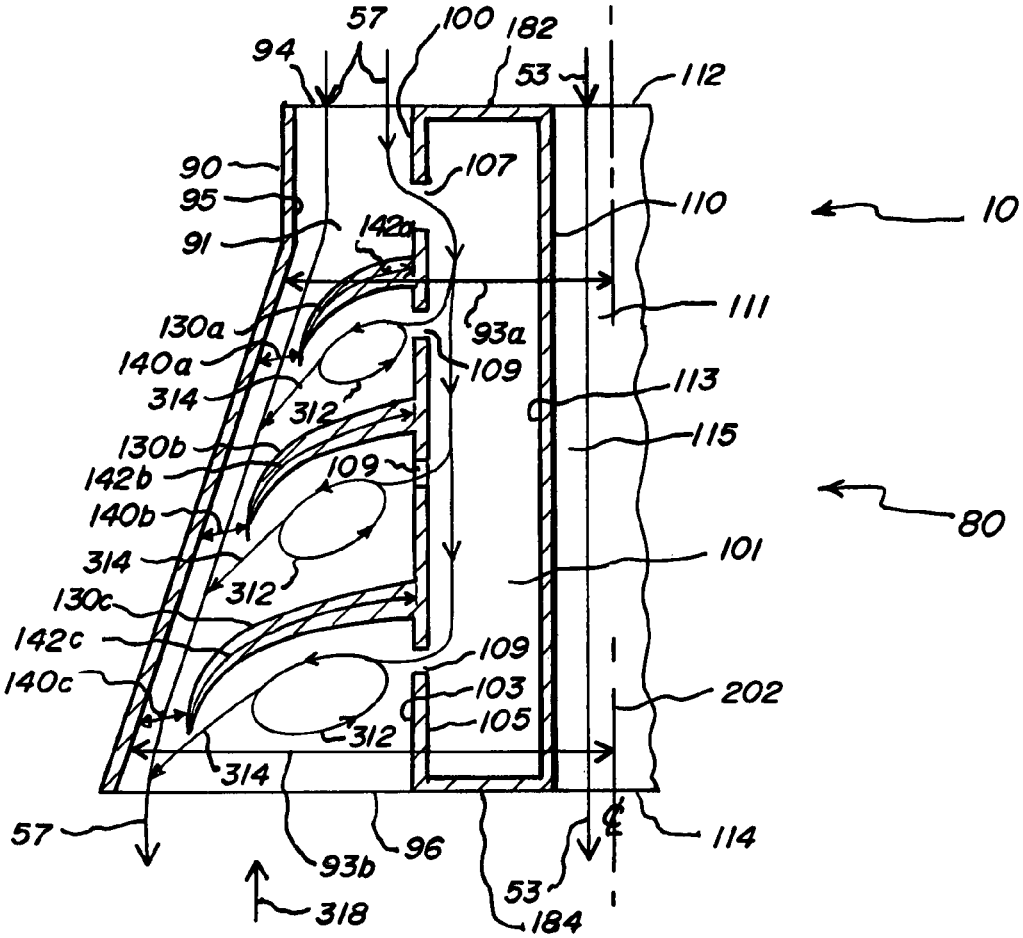
FIG. 5 illustrates a cut-away side view of another exemplary embodiment of the diode in accordance with aspects of the present inventions.

Another embodiment of the fluid diode 80 is illustrated in FIG. 5. The outer body 90, in this embodiment, is partly cylindrical in shape and partly frusto-conical in shape and the inner body 100 is generally cylindrical in shape, so that the cross-sectional area of a portion of the outer passage 91 defined by the outer body wall 95 and the first inner body wall 103 is substantially constant generally proximate the diode first end 94. The cross-sectional area of the remaining portion of the outer passage 91 increases toward the diode second end 96 as indicated by the radius 93 of the outer body wall 95 from the centerline 202, denoted as radii 93*a*, 93*b* in this illustration. Vanes 130 denoted as vanes 130*a*, 130*b*, 130*c* are secured to the first inner body wall 93 in this embodiment. The vanes 130*a*, 130*b*, 130*c*, in this embodiment, have correspondingly increasing chords 142*a*, 142*b*, 142*c* to maintain generally constant gaps 140*a*, 140*b*, 140*c*. The flaring of the outer body 90 to increase the cross-sectional area of the outer passage 91 toward the diode second end 96 may reduce drag on the airflow 57 and choke backflow 318.

Figure 6:
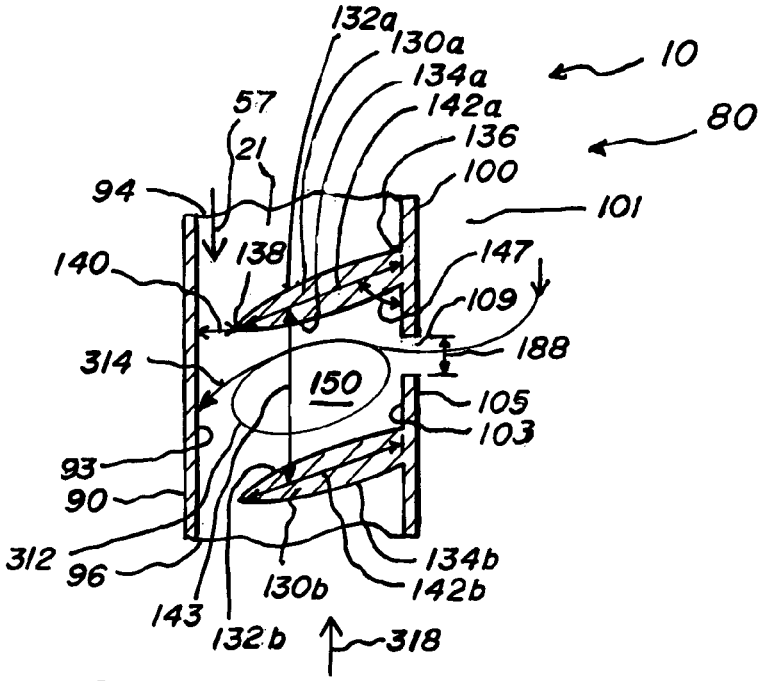
FIG. 6 illustrates a cut-away side view of an exemplary embodiment of portions of the fluid diode in accordance with aspects of the present inventions.

FIG. 6 illustrates an embodiment of a portion of the fluid diode 80 including the outer passage 91. Two vanes 130*a*, 130*b* are secured to the first inner body wall 103 of the inner body 100 at vane attachments 136. Vanes 130*a*, 130*b* define corresponding chords 142*a*, 142*b*, as illustrated. As illustrated, the gap 140 is the distance between the vane tip 138 and the outer body wall 95. The wall angle 147 may be defined as the angle of the chord 142*a* with respect to the first inner body wall 103, as illustrated. The offset 143 in the illustrated embodiment is defined as the distance between chord 142*a* and chord 142*b*. Region 150 may be defined as the region generally bounded by first vane surface 132*b*, second vane surface 134*a*, and first inner body wall 103 as illustrated in FIG. 6. Airflow 57 may be distributed into region 150 from inner passage 101 through outlet port 109 to create eddy 312 and cross-flow 314. The outlet port 109 may be configured as a slit with outlet port width 188 that extends generally circumferentially about the inner body 100, as illustrated. In other embodiments, the outlet port 109 may be configured as generally circular, oval, or other shape or combinations of shapes, and a plurality of outlet ports 109 may communicate into the region 150.

Figure 7A:
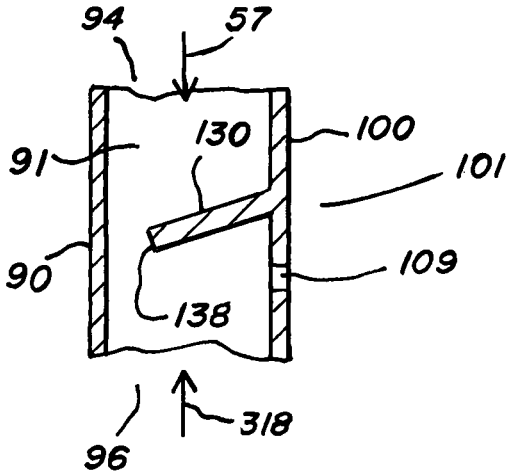
FIG. 7A illustrates a cut-away side view of an exemplary embodiment of portions of the fluid diode in accordance with aspects of the present inventions; and, FIG. 7B illustrates a cut-away side view of an exemplary embodiment of portions of the fluid diode in accordance with aspects of the present inventions.
Figure 7B:
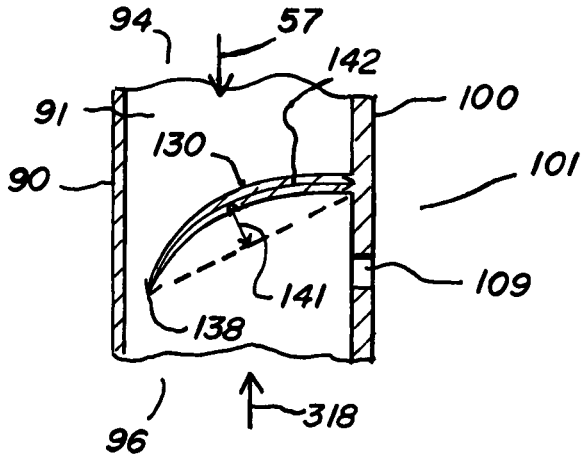

FIG. 7A illustrates an embodiment of vane 130 secured to the first inner body wall 103. In this figure, the vane 130 is generally configured as a flat plate having essentially zero camber 141. By contrast, the embodiment of the vane illustrated in FIG. 7B has camber 141 to orient the vane tip 138 generally toward the diode second end 96. The vane 130 may have various other shapes and various descriptors may be used to describe those shapes as would be recognized by those of skill in the art upon review of this disclosure.

The present inventions also provide methods for pulse combustion drying. In various aspects, the methods may include providing a pulse combustion dryer apparatus 10 for drying a dryer feed material 73 having a combustor 31, an air inlet 21, a fluid diode 80, and a tailpipe 40, with the combustor 31 defining a combustion chamber 32, and the air inlet 21 defining an air inlet passage 23 fluidly communicating with the combustion chamber 32. The tailpipe 40 defining a tailpipe passage 42 fluidly communicating with the combustion chamber 23 may also be part of the methods. The methods may further include positioning the fluid diode 80 within the air inlet passage 23 and controlling airflow 57 and backflow 318 through the air inlet passage 23 using the fluid diode 80. In various aspects, the methods may include receiving a pulse of airflow 57 through the air inlet 21 and a pulse of fuel 53 into the combustion chamber 32, igniting periodically the resulting fuel-air mixture thereby producing pulses of heated combustion products 59, and expelling the pulses of heated combustion products 59 through the tailpipe passage 42. The fluid diode 80 within the air inlet 21 generally preventing the backflow 318 of heated combustion products 59 through the air inlet 21 while allowing airflow 57 through the air inlet 21 into the combustion chamber 32 to replenish the air 55 in the combustion chamber 32 between pulses may be included in the methods. Introducing the dryer feed material 73 into the pulses of heated combustion products 59 to generally dry the dryer feed material 73 into dried material 75 by thermally evaporating and/or mechanically stripping water from the dryer feed material 73 and collecting the dried material 75 using a collector 50 may be included in the methods in various aspects. In some aspects, the methods may involve introducing the dryer feed material 73 into the pulses of heated combustion products 59 in the drying passage 68. Various aspects may include providing a drying chamber 60 defining a drying chamber passage 62 and introducing the dryer feed material 73 into pulses of heated combustion products 59 within the drying chamber passage 62.

The methods may include disposing the fluid diode 80 within the air inlet passage 23 to allow airflow through the air inlet passage 23 into the combustion chamber 32 and to generally prevent backflow 318 of heated combustion products 59 through the air inlet passage 23 from the combustion chamber 32. Providing one or more vanes 130, an outer body 90, the outer body 90 defining an outer body wall 95, and an inner body 100, the inner body 100 defining a first inner body wall 103 and a second inner body wall 105, and disposing the outer body 90 and the inner body 100 with respect to one another thereby defining an outer passage 91 by the outer body wall 95 and the first inner body wall 103 may be included in the methods. Securing the one or more vanes 130 circumferentially to the first inner body wall 103, the one or more vanes 130 extending into the outer cavity 91 and communicating airflow 57 through the outer cavity 91 generally from the diode first end 94 to the diode second end 96 may be included in the methods. The methods, in various aspects, may include the second inner body wall 105 defining, at least in part, an inner passage 101, disposing one or more inlet ports 107 about the inner body 100, admitting airflow 57 into the inner passage 101, disposing one or more outlet ports 109 about the inner body 100, and dispersing airflow 57 from the inner passage 101 about the one or more vanes 130 in the outer passage 91 thereby creating eddies 312 and cross-flow 314 generally in one or more regions 105.

Including an inner sleeve 110 having a first inner sleeve wall 113 and a second inner sleeve wall 115, and disposing the inner sleeve 110 with respect to the inner body 100 thereby defining the inner passage 101 by the second inner body wall 105 and the first inner sleeve wall 113 may be included in the methods in various aspects. Various aspects of the methods may include defining a sleeve passage 111 by the second inner sleeve wall 115 and communicating fuel 53 generally from the first diode end 94 to the second diode end 96 through the sleeve passage 111. Providing a dispersion structure 170, the dispersion structure 170 fluidly communicating with the sleeve passage 111 generally proximate a second sleeve passage end 114, the dispersion structure 170 dispersing fuel 53 into the airflow 57 communicated through the outer passage 91 may be included in the methods. Configuring the one or more inlet ports 107 to admit airflow 57 from the air inlet passage 23 into the inner passage 101, and admitting airflow 57 from the air inlet passage 23 into the inner passage 101 may be included in the methods in some aspects. In other aspects, the methods may include configuring the one or more inlet ports 107 to communicate airflow from a compressed air source 220 into the inner passage 101, and communicating airflow 57 from the compressed air source 220 into the inner passage 101.

The foregoing discussion discloses and describes merely exemplary embodiments of the present inventions. Upon review of the specification, one skilled in the art will readily recognize from such discussion, and from the accompanying figures and claims, that various changes, modifications and variations can be made therein without departing from the spirit and scope of the invention as defined in the following claims.

What is claimed is:

1. A pulse combustion dryer apparatus, comprising:

an air inlet passage;

a pulse combustor, in fluid communication with the air inlet passage to receive airflow through the air inlet passage; and, a fluid diode positioned in the air inlet passage, the diode including an outer body defining an outer body wall, an inner body, the inner body defining a first inner body wall and a second inner body wall, the inner body is disposed with respect to the outer body such that the first inner body wall and the outer body wall define an outer passage, the fluid diode includes one or more vanes secured to the first inner body wall and extended toward the outer body wall, the second inner body wall defines, an inner passage, one or more inlet ports are disposed about the inner body generally proximate a diode first end to admit airflow into the inner passage and one or more outlet ports are disposed about the inner body to distribute airflow from the inner passage into the outer passage to create turbulence, including eddies and cross-flow;

wherein the one or more vanes of the fluid diode generally prevents backflow of heated combustion products through the air inlet passage from the pulse combustor.

2. The pulse combustion dryer apparatus, as in claim 1, further comprising:

an inner sleeve, the inner sleeve defines a first inner sleeve wall and a second inner sleeve wall, the inner sleeve is disposed with respect to the inner body such that the second inner body wall and the first inner sleeve wall define the inner passage, the second inner sleeve wall defines a sleeve passage with a first sleeve passage end and a second sleeve passage end, the sleeve passage in fluid communication with the pulse combustor to communicate fuel into the pulse combustor.

3. The pulse combustion dryer apparatus, as in claim 2, further comprising:

a dispersion structure, the dispersion structure in fluid communication with the sleeve passage generally proximate the second sleeve passage end to disperse fuel into the airflow communicated through the outer passage.

4. The pulse combustion dryer apparatus, as in claim 1, further comprising:

the one or more inlet ports configured to admit airflow from the air inlet passage into the inner passage.

5. The pulse combustion dryer apparatus, as in claim 1, further comprising:

the one or more inlet ports configured to communicate airflow from a compressed air source into the inner passage.

6. The pulse combustion dryer apparatus of claim 1, further comprising a tailpipe, in fluid communication with the pulse combustor for expelling combustion products.

7. The pulse combustion dryer of apparatus of claim 6, wherein the tailpipe is flared.

8. The pulse combustion dryer of apparatus of claim 6, wherein one or more of the combustor, tailpipe and air inlet are comprised, at least partially, of a high temperature ceramic material.

9. The pulse combustion dryer of apparatus of claim 8, wherein the high temperature ceramic material comprises silicon nitride, silicon carbide, alumina oxide, Mullite-type ceramics or a combination thereof.

10. The pulse combustion dryer of apparatus of claim of claim 8, wherein the high temperature ceramic material comprises a surface layer of one or more catalytic metals.

11. The pulse combustion dryer of apparatus of claim of claim 10, wherein the catalytic metals comprise platinum, nickel or a combination thereof.

12. The pulse combustion dryer of apparatus of claim 6, wherein one or more of the combustor, tailpipe and air inlet are comprised, at least partially, of a high temperature stainless steel.

13. The pulse combustion dryer of apparatus of claim 12, wherein the stainless steel comprises a surface layer of a high temperature ceramic material, a zirconia-based coating or a combination thereof.

14. The pulse combustion dryer of apparatus of claim 1, wherein the pulse combustor comprises a resonator.

15. A method, comprising:

forming a fluid diode, the diode including an outer body defining an outer body wall, an inner body, the inner body defining a first inner body wall and a second inner body wall, the inner body is disposed with respect to the outer body such that the first inner body wall and the outer body wall define an outer passage, the fluid diode includes one or more vanes secured to the first inner body wall and extended toward the outer body wall, the second inner body wall defines, an inner passage, one or more inlet ports are disposed about the inner body generally proximate a diode first end to admit airflow into the inner passage and one or more outlet ports are disposed about the inner body to distribute airflow from the inner passage into the outer passage to create turbulence, including eddies and cross-flow;

disposing the fluid diode in an air inlet passage of a pulse combustion dryer having a pulse combustion chamber, admitting airflow into the inner passage through the one or more inlet ports;

and distributing airflow from the inner passage into the outer passage through the one or more outlet ports thereby creating eddies and cross-flow in the outer passage, generally preventing backflow of heated combustion products from the combustion chamber to the air inlet passage.

16. The method, as in claim 15, further comprising:

providing an inner sleeve defining a first inner sleeve wall, a second inner sleeve wall, and a sleeve passage with a first sleeve passage end and a second sleeve passage end, the sleeve passage fluidly communicating with the combustion chamber through the second sleeve passage end;

disposing the inner sleeve with respect to the inner body thereby defining the inner passage by the second inner body wall and the first inner sleeve wall; and communicating fuel into the combustion chamber through the sleeve passage.

17. The method, as in claim 16, further comprising:

providing a dispersion structure, the dispersion structure in fluid communication with the sleeve passage generally proximate the second sleeve passage end; and dispersing fuel through the dispersion structure into the airflow communicated through the outer passage.

18. The method, as in claim 15, further comprising:

admitting airflow from the air inlet passage into the inner passage.

19. The method, as in claim 15, further comprising:

communicating airflow from a compressed air source into the inner passage.

* * * * *